US006794346B2

(12) United States Patent
Wick et al.

(10) Patent No.: US 6,794,346 B2
(45) Date of Patent: Sep. 21, 2004

(54) HARD SURFACE CLEANERS CONTAINING CHITOSAN AND FURANONE

(75) Inventors: Roberta A. Wick, Racine, WI (US); Richard W. Avery, High Wycombe (GB); Ian Robb, Stevens, OK (US)

(73) Assignee: S.C. Johnson & Son, Inc., Racine, WI (US)

( * ) Notice: Subject to any disclaimer, the term of this patent is extended or adjusted under 35 U.S.C. 154(b) by 43 days.

(21) Appl. No.: 10/035,318

(22) Filed: Oct. 26, 2001

(65) Prior Publication Data

US 2003/0083224 A1 May 1, 2003

(51) Int. Cl.[7] ..... C11D 1/00; C11D 3/26; C11D 3/24; C11D 3/43

(52) U.S. Cl. ..... 510/238; 510/191; 510/421; 510/422; 510/433; 510/434; 510/471; 510/473; 510/477; 510/488; 510/499; 510/504; 510/383

(58) Field of Search ..... 510/191, 238, 510/421, 422, 433, 434, 471, 477, 488, 499, 504, 473, 383

(56) References Cited

U.S. PATENT DOCUMENTS

| | | | | | |
|---|---|---|---|---|---|
| 4,931,271 | A | | 6/1990 | Lang et al. | |
| 4,957,908 | A | | 9/1990 | Nelson | |
| 5,008,108 | A | | 4/1991 | Rha et al. | |
| 5,061,393 | A | | 10/1991 | Linares et al. | |
| 5,512,199 | A | | 4/1996 | Khan et al. | |
| 5,541,233 | A | | 7/1996 | Roenigk | |
| 5,731,025 | A | | 3/1998 | Mitchell | |
| 5,776,876 | A | * | 7/1998 | Garris | 510/247 |
| 5,851,980 | A | | 12/1998 | Avery | |
| 5,968,485 | A | * | 10/1999 | Robinson | 424/59 |
| 6,022,549 | A | | 2/2000 | Dyer | |
| 6,042,877 | A | | 3/2000 | Lyon et al. | |
| 6,060,046 | A | | 5/2000 | Steinberg et al. | |
| 6,068,835 | A | * | 5/2000 | Franzke et al. | 424/70.11 |
| 6,153,208 | A | * | 11/2000 | McAtee et al. | 424/402 |
| 6,162,423 | A | * | 12/2000 | Sebag et al. | 424/70.12 |
| 6,190,678 | B1 | * | 2/2001 | Hasenochri et al. | 424/401 |
| 6,338,855 | B1 | * | 1/2002 | Albarcarys et al. | 424/409 |
| 6,387,855 | B1 | * | 5/2002 | De La Mettrie | 510/122 |
| 6,432,892 | B2 | * | 8/2002 | Meine et al. | 510/111 |

FOREIGN PATENT DOCUMENTS

| | | | | |
|---|---|---|---|---|
| WO | WO 96/29392 | | 9/1996 | |
| WO | WO 99/03959 | * | 1/1999 | |
| WO | WO 99/53915 | | 10/1999 | |
| WO | WO 99/54323 | | 10/1999 | |
| WO | WO 01/42415 A1 | | 6/2001 | C11D/3/37 |
| WO | WO 01/43739 A1 | | 6/2001 | A61K/31/341 |
| WO | WO 01/68090 | | 9/2001 | |
| WO | WO 01/76594 A1 | | 10/2001 | A61K/31/341 |
| WO | WO 02/47681 A1 | | 6/2002 | A61K/31/365 |

OTHER PUBLICATIONS

Henkel advertising literature entitled "From The Depths Of The Sea" undated, admitted prior art.

R. de Nys et al.: New halogenated furanones from the marine alga *Delisea pulchra* (*cf. fimbriata*), 49 Tetrahedron 11213–11220 (1993).

R. de Nys et al.: *Delisea pulchra* (*cf. fimbriata*) revisited . . . 45 J. Aust. Chem. 1625–1632 (1992).

* cited by examiner

*Primary Examiner*—Gregory R. Del Cotto

(57) ABSTRACT

Disclosed herein are acidic aqueous hard surface cleaners and methods for using them. The cleaners include a poly D-glucosamine such as chitosan and also a furanone. The cleaners provide residual benefits on the hard surface such as soil resistance and resistance to bacteria, molds and biofilms.

6 Claims, 8 Drawing Sheets

HARD SURFACE CLEANERS CONTAINING CHITOSAN AND FURANONE

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

The present invention relates to cleaning compositions for hard surfaces. They appear to be especially well suited for use in cleaning toilets, baths, shower surrounds and other plumbing fixtures, bathroom and kitchen hard surfaces, drains and floor surfaces.

The art has developed a variety of hard surface cleaning compositions, including some which are acidic. For example, U.S. Pat. No. 5,008,030 discloses cleaning compositions that contain nonionic surfactants, a monocarboxylic acid, water, and other additives. The disclosure of this patent and of all other patents described herein are incorporated by reference as if fully set forth herein. Also, U.S. Pat. No. 5,061,393 teaches a hard surface cleaner that is a mixture of a zwitterionic surfactant, nonionic surfactant, citric acid, and various other components, and U.S. Pat. No. 5,851,980 teaches aqueous acidic liquid hard surface cleaners having nonionic surfactants, glycolic and lactic acids, N-alkyldimethyl benzyl ammonium chloride, and fragrance. Ether solvents are also taught in the last of these patents.

U.S. Pat. No. 5,061,397 also teaches hard surface cleaners with butyl cellosolve, citric acid, and colorants. Other publications describe the use of sulfamic acid, amine oxides and cellulosic thickeners and hard surface cleaners.

While these varied prior art hard surface cleaners have provided a variety of ways to clean hard surfaces, they have been limited in their ability to provide residual benefits to the surfaces being cleaned. In this regard, it is desirable to render hard surfaces that are being cleaned more resistant to becoming soiled, and to provide the surface with antimicrobial characteristics.

Chitosan is a poly D-glucosamine that has been isolated from the shells of crabs, lobsters or shrimps, or derived from chitin. Chitosan has previously been added to certain skin and hair care products, including some that contain surfactants and water. In these applications chitosan is used for its protective effects. Examples of such products include hair setting preparations, hair gels, hair mousses, styling creams, anti-dandruff preparations, hair tonics, hair rinses, skin moisturizers, deodorants and antiperspirants. See also U.S. Pat. No. 4,931,271 which describes certain problems in using chitosan in shampoos with anionic surfactants.

Chitosan has also been used in a number of other contexts. For example, U.S. Pat. No. 5,541,223 teaches that chitosan can be included in a sponge. However, Applicants believe that the art had not previously included chitosan in a hard surface cleaner.

U.S. Pat. No. 6,060,046 discloses the use of certain furanones to reduce biofouling in marine applications. The reference does not describe the use of these furanones in a hard surface cleaner.

International Patent Publication No. WO 96/29392 is directed to methods and culture media including furanones for inhibiting homoserine lactone (HSL) and/or acylated homoserine lactone (AHL) regulated processes in microorganisms, including bacteria, fungi and algae.

International Patent Publication No. WO 99/53915 discloses a method of inhibiting the growth of gram positive bacteria using one or more furanones.

International Patent Publication No. WO 99/54323 demonstrates diverse side-chain functionalizations of furanones.

Notwithstanding all this art, there is still a continuing need to develop environmentally friendly hard surface cleaners which not only are effective in cleaning at the time of use, but also provide positive residual benefits to the surface that has been cleaned.

BRIEF SUMMARY OF THE INVENTION

In one aspect the invention provides a hard surface cleaner having a pH below 6.0, one or more surfactants in the 0–10% (preferably 0.1–10%) weight range, a poly D-glucosamine at less than 2% by weight, a furanone (preferably at below 5% by weight, and even more preferably at about 1% by weight), and water. The preferred poly D-glucosamine is chitosan, and the preferred furanones are halogenated (preferably with bromine).

FIGS. 2–8 of this application depict preferred furanones 1–54. Furanones should also be suitable, such as those described in the above PCT applications and/or in U.S. Pat. No. 6,060,046 (the disclosures of these applications and patents being incorporated by reference as if fully set forth herein). See also R. de Nys et al., 49 Tetrahedron 11213–11220 (1993) and R. de Nys et al., 45 J. Aust. Chem. 1625–1632 (1992) for additional furanones.

Normally more than 50% of the cleaner should be water (preferably over 90% of the cleaner), and there should normally be an acid.

The cleaners can include a wide variety of surfactants such as nonionic, anionic, cationic and amphoteric surfactants, and mixtures thereof. Examples of such surfactants are described in McCutcheon's: Emulsifiers & Detergents, North American Edition (1995).

Suitable nonionic surfactants include alkyl amine oxides (e.g. $C_{8-20}$ alkyl dimethyl amine oxides), alkylphenol ethoxylates, linear and branched alcohol ethoxylates, carboxylic acid esters, alkanolamides, alkylpolyglycosides, ethylene oxide/propylene oxide copolymers, and the like. Especially preferred among these are linear and secondary alcohol ethoxylates, octyl- and nonyl-phenol ethoxylates, alkanol amides and alkylpolyglycosides.

Useful zwitterionic/amphoteric surfactants include alkyl aminopropionic acids, alkyl iminopropionic acids, imidiazoline carboxylates, alkylbetaines, sulfobetaines, and sultaines.

Useful cationic surfactants include, for example, primary amine salts, diamine salts, quaternary ammonium salts, and ethoxylated amines.

Useful anionic surfactants (which are preferably used only in conjunction with a nonionic surfactant, if at all) include carboxylic acid salts, alkyl benzene sulfonates, secondary n-alkane sulfonates, alpha-olefin sulfonates, dialkyl diphenylene oxide sulfonates, sulfosuccinate esters, isoethionates, linear alcohol sulfates (alkyl sulfates), and linear alcohol ethoxy sulfates.

The poly D-glucosamine is preferably a chitosan (such as that available from Henkel/Cognis under the trade name Hydagen NH). Coarse grades are alternatively available by being ground from crab shells. More pure forms can be obtained by deacetylation of chitin.

The acid is preferably less than 10% of the cleaner, even more preferably less than 5% of the cleaner. Preferred acids are organic acids such as lactic acid, sulfamic acid, citric acid, valeric acid, hexanoic acid, and glycolic acid. Other examples are formic acid, acetic acid, propionic acid, butyric acid, and gluconic acid, and peroxy variants of these acids such as peroxyacetic acid.

In order to optimize the effectiveness of chitosan and furanone the pH should be below 6.0, preferably below 5.0, and even more preferably between 2 and 5. This can be achieved by appropriate use of acids to remove limescale (e.g. in a toilet bowl cleaner), with a modifying base such as sodium hydroxide to fine-tune the pH if needed.

There may also be a glycol ether solvent (most preferably ethylene glycol hexyl ether or ethylene glycol butyl ether). This is particularly desirable for kitchen cleaners where there is substantial grease that needs to be cleaned. Other possible solvents are terpenes, aliphatic hydrocarbons and alpha-olefins, and organic compounds containing at least one oxygen atom, such as alcohols and ethers.

Among these oxygen-containing solvents are aliphatic alcohols of up to 8 carbon atoms, particularly tertiary alcohols of up to 8 carbon atoms; aromatic-substituted alcohols; alkylene glycols of up to 6 carbon atoms; polyalkylene glycols having up to 6 carbon atoms per alkylene group; mono- or dialkyl ethers of alkylene glycols or polyalkylene glycols having up to 6 carbon atoms per glycol group and up to 6 carbons atoms in each alkyl group; mono- or diesters of alkylene glycols or polyalkylene glycols having up to 6 carbon atoms per glycol group and up to 6 carbon atoms in each ester group.

Specific examples of solvents include t-butanol, t-pentyl alcohol, 2,3-dimethyl-2-butanol, benzyl alcohol or 2-phenyl ethanol, ethylene glycol, propylene glycol, propylene glycol mono-n-butyl ether, dipropylene glycol mono-n-butyl ether, propylene glycol mono-n-propyl ether, dipropylene glycol mono-n-propyl ether, diethylene glycol mono-n-butyl ether, diethylene glycol monomethyl ether, dipropylene glycol monomethyl ether, triethylene glycol, propylene glycol monoacetate, and dipropylene glycol monoacetate. The solvent preferably constitutes no more than 6 weight percent of the composition, more preferably no more than 2 weight percent.

For some applications such as toilet cleaners and bathroom cleaners it may be desirable that the cleaner also contain a cellulosic thickener. A preferred thickener is hydroxyethyl cellulose.

If desired another disinfectant can be used (preferably benzalkonium chloride such as BTC 2125 M). Other possible disinfectants include polyhexamethylene biguanide, phenolic disinfectants, amphoteric disinfectants, anionic disinfectants, and metallic disinfectants (e.g. silver).

In another form, the invention provides a method of cleaning a hard surface. One applies a cleaner of the above kind against the hard surface (e.g. by rubbing), then rinses the surface with water.

By "hard surface" we mean a solid, substantially non-flexible, surface such as a counter top, bathroom tile, plumbing fixture wall, bathroom or kitchen wall, or linoleum floor. This term does not include fabric, carpet, hair, skin, or other materials which are highly flexible.

It has been surprisingly learned that the addition of poly D-glucosamines (particularly chitosan) in combination with furanones, to a hard surface cleaner (particularly an acidic hard surface cleaner containing a nonionic surfactant) causes surfaces that have been cleaned using the cleaner to resist staining, be easier to clean when stained, and resist the growth of bacteria, molds and biofilms. These benefits have been achieved without disrupting the cleaning function of the cleaner.

Chitosan is a naturally occurring material which can be obtained at relatively low cost. It is non-toxic, biodegradable and is a renewable resource. Thus, it does not present additional environmental concerns. Furanones are similarly environmentally friendly.

The foregoing and other advantages of the invention will appear from the following description. In that description reference is made to the accompanying drawing which forms a part hereof. These embodiments do not represent the full scope of the invention. Thus, the claims should be looked to in order to judge the full scope of the invention.

DETAILED DESCRIPTION OF THE PREFERRED EMBODIMENTS

Disinfectant cleaners, such as might be used to clean a toilet bowl, are:

EXAMPLE 1

| Weight percent | Description | Chemical Name |
|---|---|---|
| to 100 | carrier | water |
| 1.0 | amine oxide surfactant | alkyl dimethyl amine oxide |
| .55 | quaternary disinfectant | BTC 2125 M |
| .75 | nonionic surfactant | Glucopon 425 N |
| .65 | acid | glycolic acid |
| 0.1 | poly D-glucosamine | chitosan |
| 0.1 | furanone | furanone 30, 1% in ethyl alcohol |
| .57 | butyl cellosolve | ethylene glycol butyl ether |
| .43 | hexyl cellosolve | ethylene glycol hexyl ether |
| .268 | base | sodium hydroxide |

EXAMPLE 2

| Weight percent | Description | Chemical Name |
|---|---|---|
| to 100 | carrier | water |
| 0.75 | nonionic surfactant | Glucopon 425 N |
| 0.10 | furanone | furanone 30, 1% in ethyl alcohol |
| 2.50 | acid | lactic or glycolic acid |
| 0.25 | poly D-glucosamine | chitosan |

EXAMPLE 3

| Weight percent | Description | Chemical Name |
|---|---|---|
| 94.828 | carrier | water |
| 1 | nonionic surfactant | Glucopon 425 N |
| .572 | acid | glycolic acid |
| 0.5 | poly D-glucosamine | chitosan |
| 0.1 | furanone | furanone 30, 1% in ethyl alcohol |
| 3 | butyl propasol | propylene glycol n-butyl ether |

EXAMPLE 4

| Weight percent | Description | Chemical Name |
|---|---|---|
| 97.828 | carrier | water |
| 1 | nonionic surfactant | Glucopon 425 N |
| .572 | acid | glycolic acid |
| 0.5 | poly D-glucosamine | chitosan |
| 0.1 | furanone | furanone 30, 1% in ethyl alcohol |

EXAMPLE 5

| Weight percent | Description | Chemical Name |
|---|---|---|
| 95.828 | carrier | water |
| .572 | acid | glycolic acid |
| 0.5 | poly D-glucosamine | chitosan |
| 0.1 | furanone | furanone 30, 1% in ethyl alcohol |
| 3 | butyl propasol | propylene glycol n-butyl ether |

EXAMPLE 6

| Weight percent | Description | Chemical Name |
|---|---|---|
| 98.828 | carrier | water |
| .572 | acid | glycolic acid |
| 0.5 | poly D-glucosamine | chitosan |
| 0.1 | furanone | furanone 30, 1% in ethyl alcohol |

Figure 1:
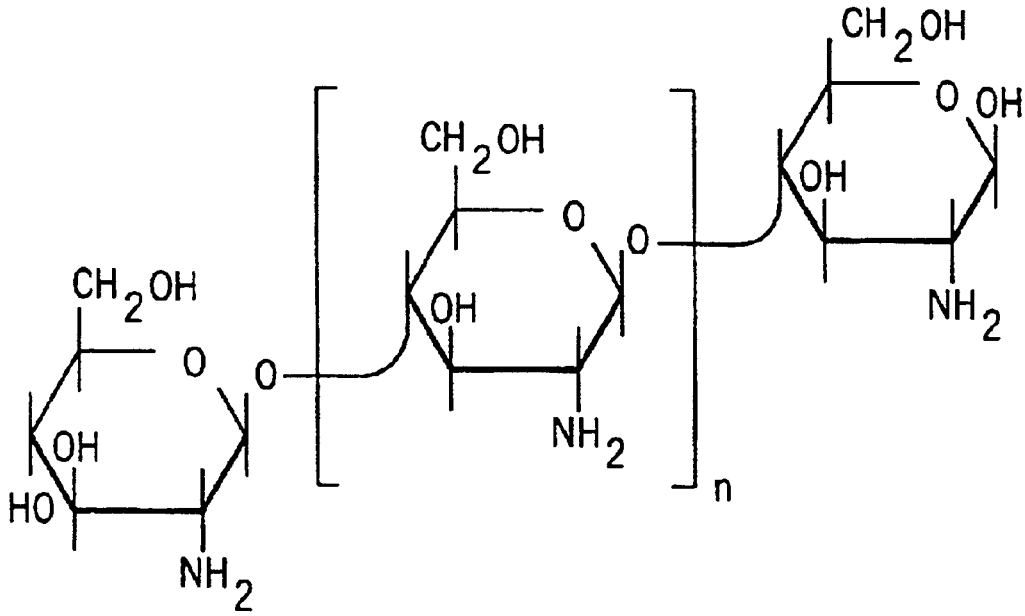
FIG. 1 is a chemical formula for chitosan.
Figure 2:
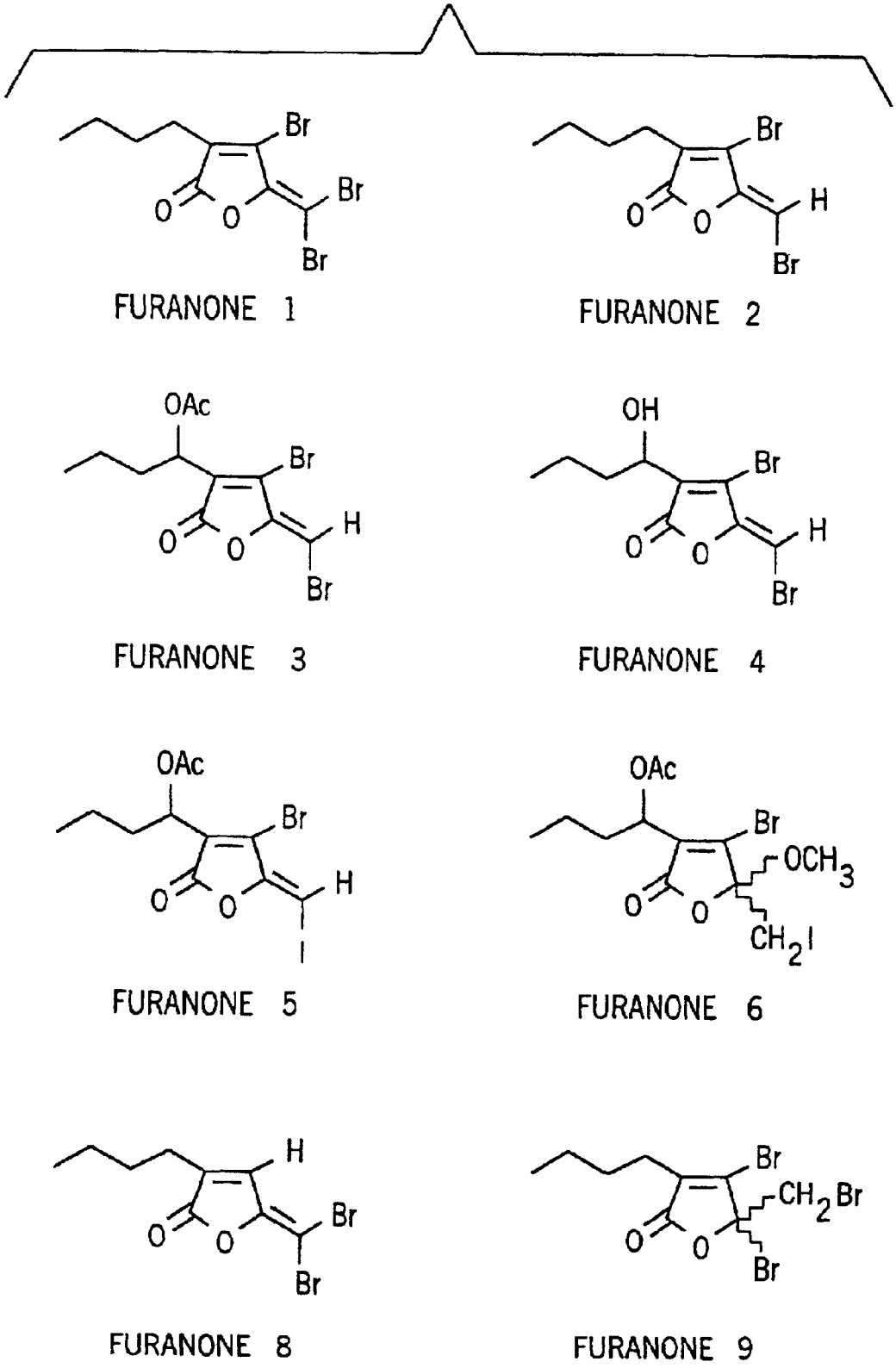
FIG. 2 depicts chemical formulas for eight furanones.
Figure 3:
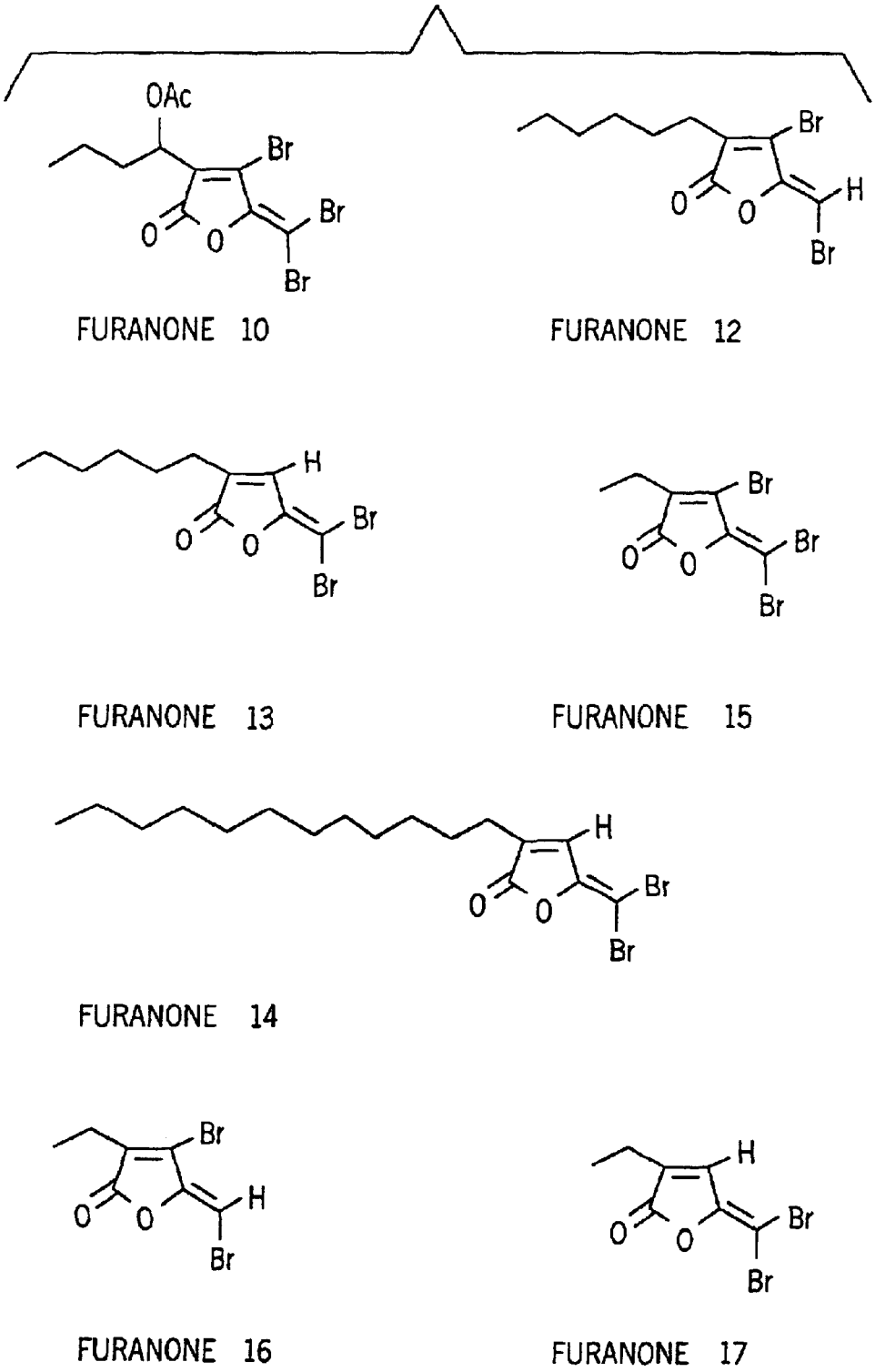
FIG. 3 depicts chemical formulas for seven additional furanones.
Figure 4:
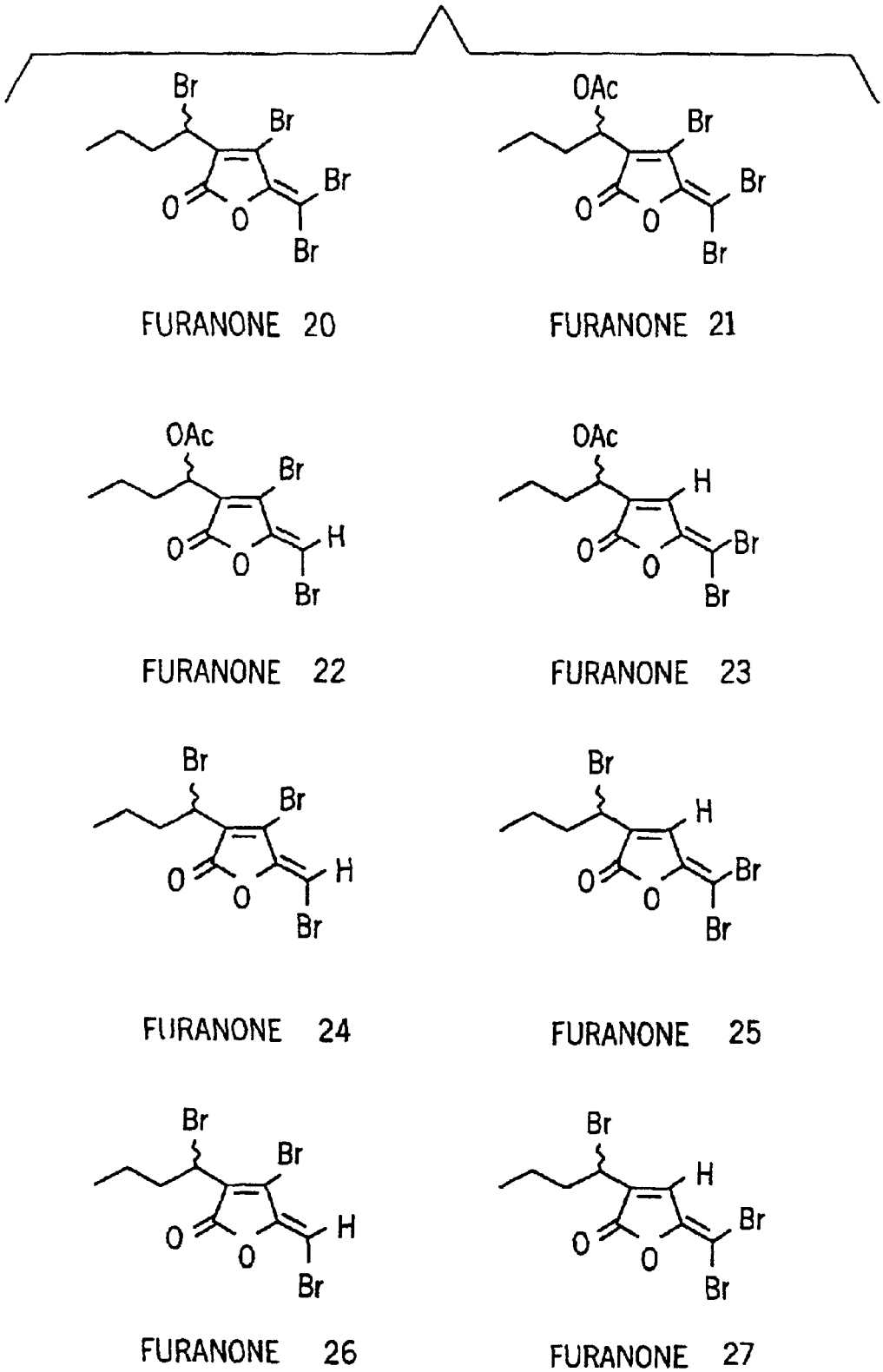
FIG. 4 depicts chemical formulas for eight additional furanones.
Figure 5:
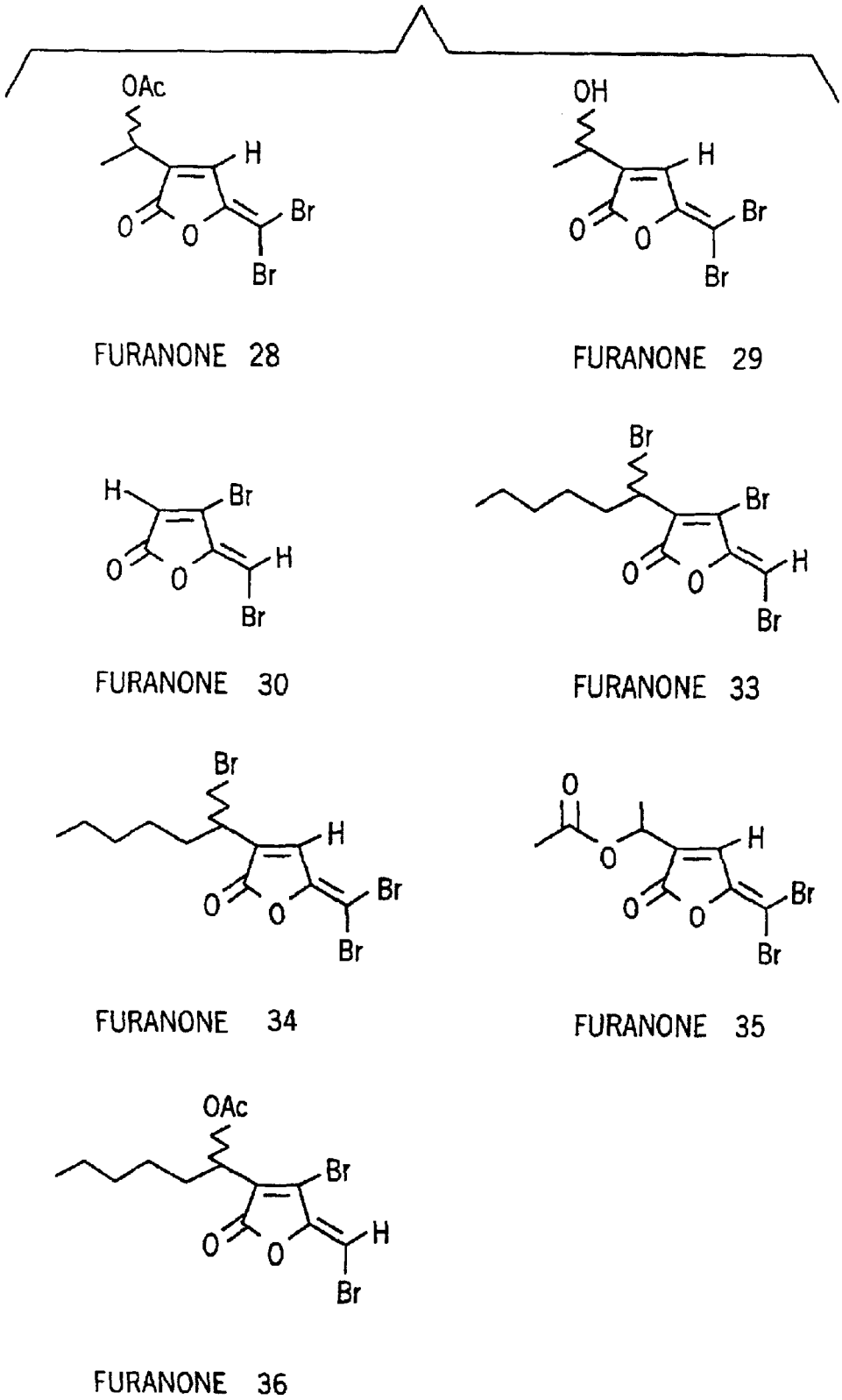
FIG. 5 depicts chemical formulas for seven additional furanones.
Figure 6:
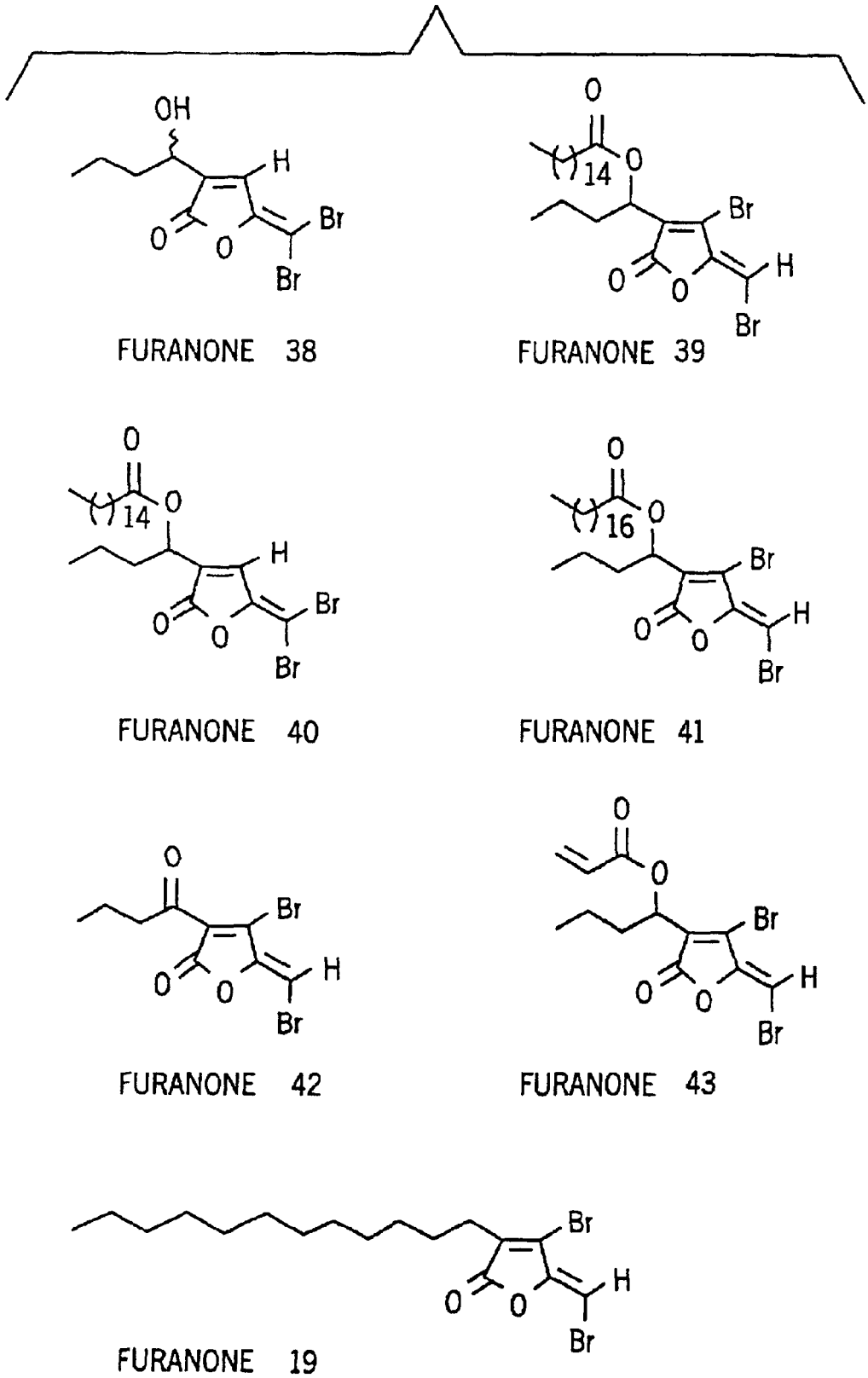
FIG. 6 depicts chemical formulas for seven additional furanones.
Figure 7:
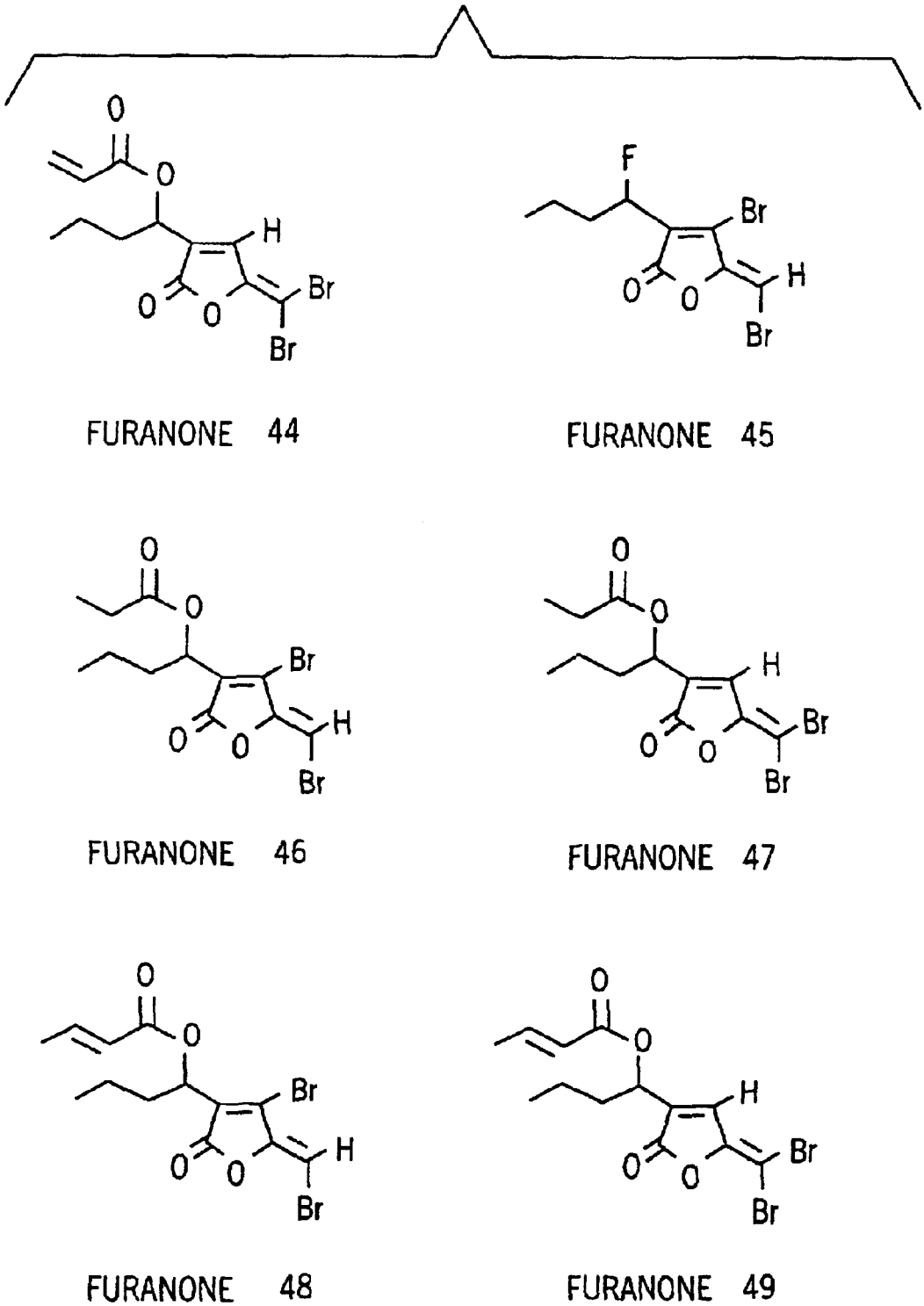
FIG. 7 depicts chemical formulas for six additional furanones.
Figure 8:
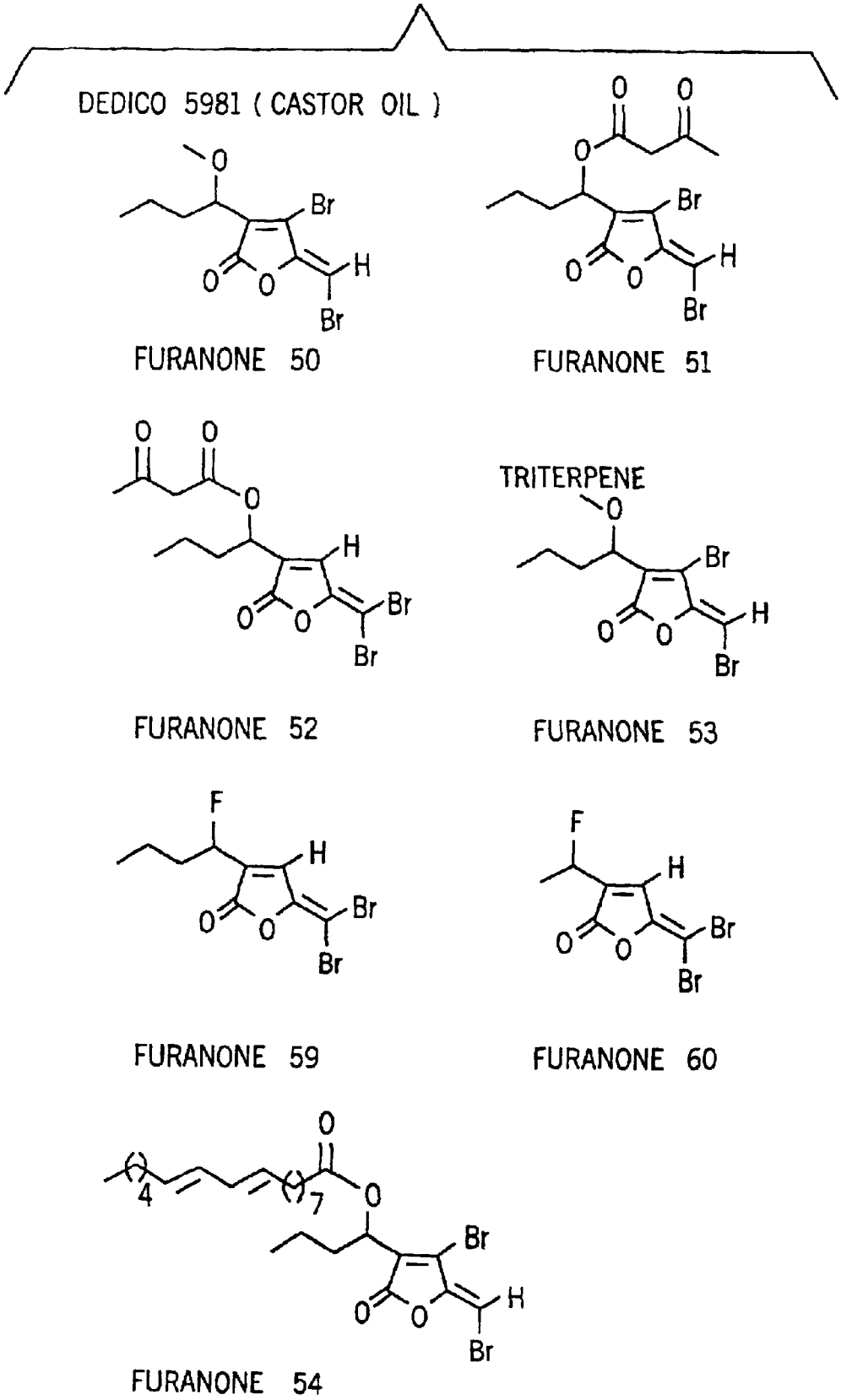
FIG. 8 depicts chemical formulas for seven additional furanones.

Furanone 30 is the "furanone 30" referred to in FIG. 5. This can be synthesized by known techniques. The samples we used for our testing were supplied by the University of New South Wales Centre for Marine Biofouling and Bio-Innovation, Sydney, Australia.

Method of Forming Preferred Embodiments

The above cleaners can be formulated by adding the components to water and then mixing at room temperature. Where an anionic surfactant is to be added, it is preferable to first add the nonionic surfactant and chitosan (as anionic surfactants alone may cause instability for the chitosan).

Testing

We tested the formulations of Examples 3–6, as well as a control containing 99.428% water and 0.572 glycolic acid, as well as a control containing just water. 4"×4" ceramic tiles (glazed) were sprayed with the formulas (3–5 times) at a distance of 6 inches. Each formula was allowed to remain on its respective tile for 10 minutes. Each tile was then wiped two times back and forth with a sterile paper towel.

After 24 hours, the tiles were dry wiped two times, back and forth with a sterile paper towel. The towels were then inoculated with 0.5 ml of $10^6$ of *Staph aureus*. After ten minutes a rodak plate (made with D/E neutralizing agar) was pressed and rocked onto the tile. The rodak plates were then placed into an incubator set at about 32° C. After two days, the plates were observed for organism growth.

The deionized water plate was completely covered with organisms. The water/acid control plate contained many organisms, but less organisms than the deionized water control. The other formula led to zero organisms in most circumstances, or at worst only one organism was visible on the tile. This confirms that formulas containing chitosan and furanone provide surprising residual antimicrobial benefit, even after the tile had been wiped back and forth after the spraying.

Thus, the present invention provides effective cleaners that not only clean hard surfaces, but also leave desirable residual properties on those surfaces after the cleaning. While the preferred embodiment incorporates chitosan, other poly D-glucosamines (e.g. substituted chitosans) can also be used. Also, while brominated furanones are highly preferred for the present purposes, a wide variety of furanones can be used for these purposes.

Thus, while specific embodiments have been described, various modifications falling within the breadth and scope of the invention. The following claims should be looked to in order to understand the full scope of the invention.

Industrial Applicability

The present invention provides improved hard surface cleaners.

We claim:

1. A hard surface cleaner having a pH below 6.0, comprising:

a surfactant which is present in an amount not greater than 10% by weight;

a poly D-glucosamine which is chitosan itself and which is present in an amount sufficient to facilitate antimicrobial activity of the cleaner in an amount less than 2% by weight;

an acid;

cellulosic thickener;

a glycol ether solvent;

a halogenated furanone which is present in an amount less than 5% by weight; and water;

wherein the hard surface cleaner is capable of causing a surface that has been cleaned with the cleaner to inhibit bacterial growth on the surface after the cleaning.

2. The hard surface cleaner of claim 1, wherein the furanone is a brominated furanone.

3. The hard surface cleaner of claim 2, wherein the acid is selected from the group consisting of lactic acid, sulfamic acid, citric acid, valeric acid, hexanoic acid, and glycolic acid.

4. The hard surface cleaner of claim 2, wherein the surfactant is a nonionic surfactant.

5. The hard surface cleaner of claim 1, further comprising a disinfectant.

6. The hard surface cleaner of claim 2, wherein the water is at least 50% by weight of the cleaner.

* * * * *